US007276664B2

(12) United States Patent
Gagnon

(10) Patent No.: US 7,276,664 B2
(45) **Date of Patent: *Oct. 2, 2007**

(54) CABLE WITH DUAL LAYER JACKET

(75) Inventor: Gilles Gagnon, Ville Lorraine (CA)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/187,476

(22) Filed: Jul. 1, 2002

(65) Prior Publication Data

US 2003/0019655 A1 Jan. 30, 2003

Related U.S. Application Data

(63) Continuation of application No. 08/664,257, filed on Jun. 7, 1996, now Pat. No. 6,441,308.

(51) Int. Cl.
*H01B 9/02* (2006.01)

(52) U.S. Cl. ..... 174/105 R; 174/121 A

(58) Field of Classification Search ..... 174/113 R, 174/36, 105 R, 107, 121 A
See application file for complete search history.

(56) References Cited

U.S. PATENT DOCUMENTS

| | | | |
|---|---|---|---|
| 3,176,065 | A | 3/1965 | Alexander et al. |
| 3,643,007 | A | 2/1972 | Roberts et al. |
| 3,660,592 | A | 5/1972 | Anderson |
| 3,676,566 | A | 7/1972 | McBride |
| 3,697,670 | A | 10/1972 | Mitacek |
| 3,823,255 | A | 7/1974 | La Gase et al. |
| 3,843,831 | A | 10/1974 | Hutchison et al. |
| 3,867,564 | A | 2/1975 | Kardashian |
| 3,945,974 | A | 3/1976 | Schwarcz et al. |

(Continued)

FOREIGN PATENT DOCUMENTS

| | | |
|---|---|---|
| CA | 1164064 | 3/1984 |

(Continued)

OTHER PUBLICATIONS

Ausimont USA, Inc., Technical Information Sheet, Hyflon Melt Processable Fluoropolymers, Mar. 1995.

(Continued)

*Primary Examiner*—Chau N. Nguyen
(74) *Attorney, Agent, or Firm*—Lowrie, Lando & Anastasi, LLP

(57) ABSTRACT

A dual layer shielded electrical cable is disclosed. The cable has at least a pair of insulated conductors, a metallic shield and a jacket surrounding the shield and insulated conductors. A first jacket layer made of flame retardant material surrounds the insulated conductors. A metallic shield then surrounds the first jacket layer. A second jacket layer then surrounds and seals the metallic shield against the first jacket layer, such that the insertion of the first jacket layer provides the cable with electrical signal attenuation and impedance characteristics equivalent to that of an unshielded cable with similar conductor insulation thicknesses. In another embodiment, a dual layer plenum rated electrical cable is disclosed. The cable has at least a pair of insulated conductors and a jacket surrounding the insulated conductors. Both the first and second jacket layer are made of a low-smoke and flame-retardant materials.

16 Claims, 4 Drawing Sheets

U.S. PATENT DOCUMENTS 4,041,237 A 8/1977 Stine et al.
4,079,191 A 3/1978 Robertson et al.
4,096,346 A 6/1978 Stine et al.
4,150,249 A 4/1979 Pedersen
4,260,661 A 4/1981 Walters et al.
4,280,225 A 7/1981 Willis
4,401,845 A 8/1983 Odhner et al.
4,412,094 A 10/1983 Dougherty et al.
4,456,654 A 6/1984 Kotian
4,500,748 A 2/1985 Klein
4,595,793 A 6/1986 Arroyo et al.
4,599,483 A 7/1986 Kuhn et al.
4,605,818 A 8/1986 Arroyo et al.
4,691,081 A * 9/1987 Gupta et al. ..... 174/105 R
4,697,051 A * 9/1987 Beggs et al. ..... 178/63 D
4,804,702 A * 2/1989 Bartoszek ..... 524/432
4,866,212 A 9/1989 Ingram
4,873,393 A * 10/1989 Friesen et al. ..... 174/34
5,010,210 A 4/1991 Sidi et al.
5,015,800 A 5/1991 Vaupotic et al.
5,024,506 A 6/1991 Hardin et al.
5,043,530 A 8/1991 Davies
5,162,609 A 11/1992 Adriaenssens et al.
5,170,010 A 12/1992 Aldissi
5,173,960 A * 12/1992 Dickinson ..... 385/100
5,206,459 A 4/1993 Aldissi
5,210,377 A 5/1993 Kennedy et al.
5,220,130 A 6/1993 Walters
5,245,134 A 9/1993 Vana, Jr. et al.
5,262,592 A 11/1993 Aldissi
5,281,766 A 1/1994 Hildreth
5,286,576 A 2/1994 Srail et al.
5,293,001 A 3/1994 Gebs
5,304,739 A 4/1994 Klug et al.
5,313,017 A 5/1994 Aldissi
5,329,064 A 7/1994 Tash et al.
5,371,325 A 12/1994 Kalola et al.
5,378,856 A 1/1995 Allen
5,393,929 A * 2/1995 Yagihashi ..... 174/36
5,408,049 A 4/1995 Gale et al.
5,541,361 A 7/1996 Friesen et al.
5,563,377 A 10/1996 Arpin et al.
5,698,323 A * 12/1997 Keough et al. ..... 428/379
5,734,126 A 3/1998 Sickierka et al.
6,147,309 A 11/2000 Mottine et al.
6,222,129 B1 4/2001 Sickierka et al.
6,392,152 B1 5/2002 Mottine, Jr. et al.
6,441,308 B1 * 8/2002 Gagnon ..... 174/105 R

FOREIGN PATENT DOCUMENTS

DE 33 37 432 A1 4/1985
EP 000258036 B1 3/1988
EP 0 410 621 A1 7/1990
EP 0 395 260 A1 10/1990
GB 2 050 041 B1 12/1980
GB 2 247 340 A 2/1992
GB 2 260 216 A 4/1993
JP 1-302611 * 12/1989
JP 3-98212 * 4/1991
JP 5-325660 B1 12/1993

OTHER PUBLICATIONS

Solvay Polymers, Inc. Technical Information Sheet, Solef PVDF Fluoropolymer, Oct. 1991.
"The Combustion of Organic Polymers", C.F. Cullis & M.M. Hirschler, Clarendon Press, Oxford (1981) pp. 307-311.

* cited by examiner

CABLE WITH DUAL LAYER JACKET

This application is a continuation of, and claims priority under 35 U.S.C. §120 to application Ser. No. 08/664,257, filed on Jun. 7, 1996 entitled: CABLE WITH DUAL LAYER JACKET, which issued on Aug. 7, 2002 as U.S. Pat. No. 6,441,308.

FIELD OF THE INVENTION

This invention relates to electrical cables, but more particularly, to dual layer jacket cables.

BACKGROUND OF THE INVENTION

The National Electrical Code—NEC (and CEC—Canadian Electric Code for Ontario and B.C.) requires the use of metal conduits for communication cables installed in the return-air plenums of office buildings; an exception to this requirement is granted by NEC and CEC provided that such cables are approved as having low flame spread and smoke producing characteristics. In order to gain this approval, the cables are tested by independent laboratories in accordance to the UL-910/NFPA 262 Standard Test Methods for Fire and Smoke Characteristics of Cables Used in Air Handling Spaces and must pass its requirements.

In addition to the safety requirements mandated by the NEC articles, modern communication cables must meet electrical performance characteristics equivalent or better than required for transmission frequencies of up to at least 100 MHz, as presently specified by ANSI/TIA-EIA specification 568-A, covering for unshielded, screened and shielded twisted pair communication cables (UTP, ScTP and STP, respectively). These requirements have further limited the choice of the materials used in such cables, namely:

(a) the insulation materials for the single conductors, and (b) the jacketing materials.

Given the stringent requirements of the UL 910/NFPA 262 test and the ANSI/TIA/EIA-568-A specification, few data communication cable constructions have qualified to date for installation in plenum spaces without the use of metal conduits, hence called plenum data grade cables.

Until recently, the most economical materials suitable for cables meeting the requirements of the ANSI/EA/TIA specifications and qualifying for plenum cables consist of the following combination:

| | |
|---|---|
| Insulation: | Conductors insulated with Fluorinated Ethylene Propylene (FEP) copolymer. |
| Jacket: | Flame-retardant and low-smoke polyvinyl chloride based polymer alloys. EthyleneChloroTriFluoroEthylene (ECTFE) copolymer was also used but has been less popular due to higher price and rigidity of the resulting cables. |

The use of FEP is a major inconvenience due to its high relative cost and limited availability. In recent developments, the use of FEP was reduced by the introduction of polyolefin (PO) substitutes. Applicant's U.S. patent application Ser. No. 08/527,531 and the Canadian patent application Serial No. 2,157,322 disclose a cable design that meets the UL-910/NFPA 262 qualification tests and the ANSI/TIA/EIA specification containing polyolefin substitutes.

Polyolefin substitutes for fluoropolymer insulation materials such as FEP include the following: the replacement of the insulation material of one or more, or all, of the conductors of a cable by a polyolefin (PO) material, or by a dual layer insulation construction where the first layer consists of a solid or cellular polyolefin material and the second layer is a fluoropolymer, or by a combination of the two alternatives. The polyolefin material could contain flame retardant additives, and/or could contain smoke suppressant additives, where all additives may or may not contain halogens. MFA and PFA are fluoropolymers having equivalent physical and electrical properties as FEP, and which can be processed very similarly to FEP, but are relatively more costly. Therefore when FEP is mentioned, MFA and PFA are included within the discussion.

With polyolefin insulation substitutes, thicker jackets are required in order to meet the UL-910/NFPA 262 qualification tests resulting in higher costs for the jacket per unit length of cable, and more difficulties during installation due to its higher rigidity.

In addition, concerns were raised regarding the long term performance of cables jacketed with flame retardant and low smoke polyvinyl chloride based polymers when exposed to high humidity and temperatures. In particular, the exposure of such cables to 95% humidity and 95° F. for as little as 300 hours was demonstrated to cause a significant increase in the signal attenuation of the cable.

Another important design requirement in data transmission is the overall shielding of cables (ScTP or S-UTP) in order to avoid electromagnetic energy being radiated from the cable and/or to the cable. This is especially true for structured cabling systems requiring transmission frequencies of up to and around 100 MHz and higher. The known art consists of applying a metal foil tape, or a metal coated polymer tape, with or without a wire braid around the cable core of insulated conductors prior to the application of the jacket. A grounding conductor in contact with the metallic foil is also applied. The metal foil tape or metallic coated polymer tape (shielding tapes or metallic foil tapes), with or without the wire braid, when properly applied and electrically grounded, will shield or screen away the electromagnetic energy being emitted from a cable into the external environment or protect a cable from interference by external sources.

The proximity of a metallic foil shield and/or a wire braid shield around the insulated conductors requires a substantial increase in insulation thickness, in order to meet signal attenuation results and a characteristic impedance equivalent to that of an unshielded cable.

The application of an efficient shield with 100% coverage consisting of a metallic foil tape with closed overlapping edges all along the length of the cable is a difficult task, due to the irregular shape and instability of the cable core. Opening of the tape overlap may occur and cause leakage or penetration of electromagnetic energy when the cable is in use.

The installation of shielded cables requires the additional manipulation of the shielding tape, the wire braid (if any), and the grounding wire during the connectorization with high density cross-connect devices or during the installation of shielded connectors.

A need therefore exists for an electrical cable which overcomes the problems of the aforementioned prior art cables.

SUMMARY OF THE INVENTION

Accordingly, it is an object of the present invention to provide an electrical cable which reduces the need for FEP or other costly fluoropolymer alternative insulation materials for plenum UL-910/NFPA 262 test qualifications of UTP, ScTP and STP data grade cables, while providing high speed data transmission performance and which can simultaneously achieve a lower jacket thickness and a lower overall cost per unit length.

Yet another object of the present invention is to provide an electrical cable which improves the shielding effectiveness of plenum and non-plenum rated cables from emitting or receiving electromagnetic energy, by using a metallic shield in the form of tape or metallic coated polymer tape with or without a wire braid.

Yet another object of the present invention is to provide a dual layer screened (ScTP) cable wherein the addition of another layer between the conductors and the shielding provides the cable with electrical signal attenuation and impedance characteristics equivalent to that of an unshielded cable with similar conductor insulation thicknesses.

Yet another object of the present invention is to provide a screened (ScTP) cable with a conductor insulation thickness which is similar to or greater than that of an unscreened (UTP) cable but less than the conductor insulation thickness of prior art screened cables.

Yet another object of the present invention is to provide an electrical cable which lowers the cost of manufacturing and installation of ScTP and STP cables for plenum and non-plenum applications.

Yet another object of the present invention is to provide an electrical cable which increases the dielectric strength between the conductors and the shield.

Yet another object of the present invention is to provide an electrical cable which protects the cables from possible transmission performance deterioration due to exposure to high temperature and relative humidity.

According to an aspect of the present invention, there is provided a shielded electrical cable having at least a pair of insulated conductors, a metallic shield and a jacket surrounding the shield and insulated conductors, comprising:

a first jacket layer surrounding said insulated conductors;

a metallic shield surrounding said first jacket layer; and a second jacket layer surrounding and sealing said metallic shield against said first jacket layer, said second jacket layer being made of flame retardant material.

According to another aspect of the present invention, there is provided a plenum rated electrical cable having at least a pair of insulated conductors and a jacket surrounding the insulated conductors, comprising:

a first jacket layer surrounding said insulated conductors, said first jacket layer being made of a low-smoke and flame-retardant material; and a second jacket layer surrounding said first jacket layer, said second jacket layer being made of flame retardant and low smoke material.

BRIEF DESCRIPTION OF THE DRAWINGS

In order to impart full understanding of the manner in which these objects and others are attained in accordance with the present invention, the preferred embodiments thereof will be described hereinafter with reference to the accompanying drawings wherein.

DESCRIPTION OF THE PREFERRED EMBODIMENTS

In order to lighten the following description, the following acronyms will be used:

| Abbreviations | |
|---|---|
| FEP | Fluorinated Ethylene Propylene copolymer. |
| MFA | MethylFluoroAlkoxy fluorinated ethylene polymer (same fluoropolymer family as FEP). |
| PFA | PerFluoroAlkoxy fluorinated ethylene polymer (same fluoropolymer family as FEP). |
| PO | Polyolefin and blends thereof which includes: Polyethylene, polypropylene, etc. in polymer form; copolymer form; elastomeric form; compounded with flame retardants, smoke suppressants or other additives that may belong to the halogenated family of additives or to the non halogenated family of additives. |
| ECTFE | EthyleneChloroTriFluoroEthylene copolymer and compounds. |
| PVDF | PolyVinyliDene Fluoride polymer, copolymer and compounds. |
| PVC | PolyVinylChloride based compounds containing flame retardants. |
| lsPVC | Low smoke PolyVinylChloride compounds containing flame retardants and smoke suppressants. |
| lsPVCba | Low smoke PolyVinylChloride based alloy compounds containing flame retardants and smoke suppressants. |
| TPE | ThermoPlastic Elastomers with or without flame retardants. |
| TPR | Thermoplastic Rubbers with or without flame retardants. |
| UTP | Unshielded Twisted Pairs. |
| STP | Shielded Twisted Pairs. |
| S-UTP | Overall Shielded cable with Unshielded Twisted Pairs. |
| ScTP | Screened Twisted Pairs (same as S-UTP). |
| ANSI | American National Standards Institute |
| TIA | Telecommunications Industry Association |
| EIA | Electronic Industries Association |
| NEC | National Electric Code |
| CEC | Canadian Electric Code |
| UL | Underwriters Laboratories, Inc. |
| CSA | Canadian Standards Association |
| NFPA | National Fire Protection Association |
| MHz | Megahertz (millions of cycles per second). |
| AWG | American Wire Gauge |

Figure 1A:
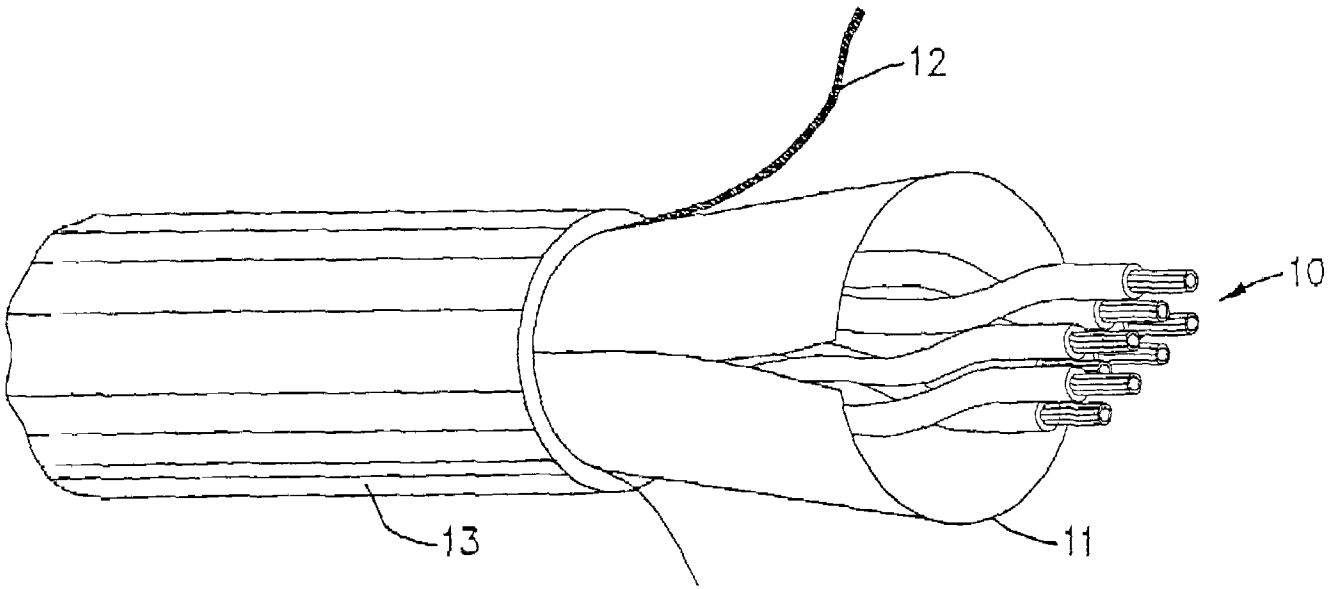
Figure 1a PRIOR ART
FIGS. 1*a* and 1*b* are a perspective and end view respectively, of a prior art shielded electrical cable.
Figure 1B:
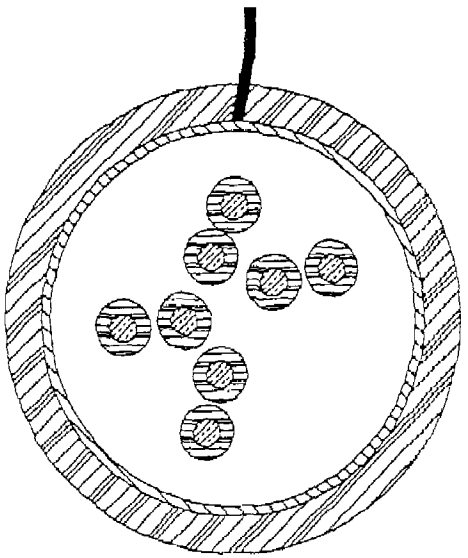
Figure 1b PRIOR ART

Referring now to FIGS. 1*a* and 1*b*, we have shown a perspective and end view, respectively of a shielded cable used in the prior art. The cable is comprised of a cable core 10 having two or more insulated conductors onto which is applied a shielding tape 11. A grounding or drain wire 12 comes in contact with the shielding tape 11 to enable connection to a grounding connector. A jacket 13 is then applied to protect the cable. With this prior art cable design, the shielding tape is applied around the cable core that is by nature of irregular form, due to the insulated conductors. In order to obtain the required tightness of the shielding tape around the cable core, the present art requires a tight jacket 13 or a tight wire braid shield (not shown) over the metallic coated tape and core in order to attempt to eliminate any openings in the shield. The effectiveness of the shield with this method remains questionable.

In addition, with the cable design of FIGS. 1*a* and 1*b*, the termination process requires the use of the grounding conductor or drain wire 12 that is in contact with the metallic foil to provide the shielding of the cable. The use of mechanical locking devices, or connectors, which are applied directly to the cable to provide the continuity between the cable shield and the system ground without the need for a grounding conductor are not feasible. They cannot be directly applied on the cable core due to its irregularity and instability.

Figure 2A:
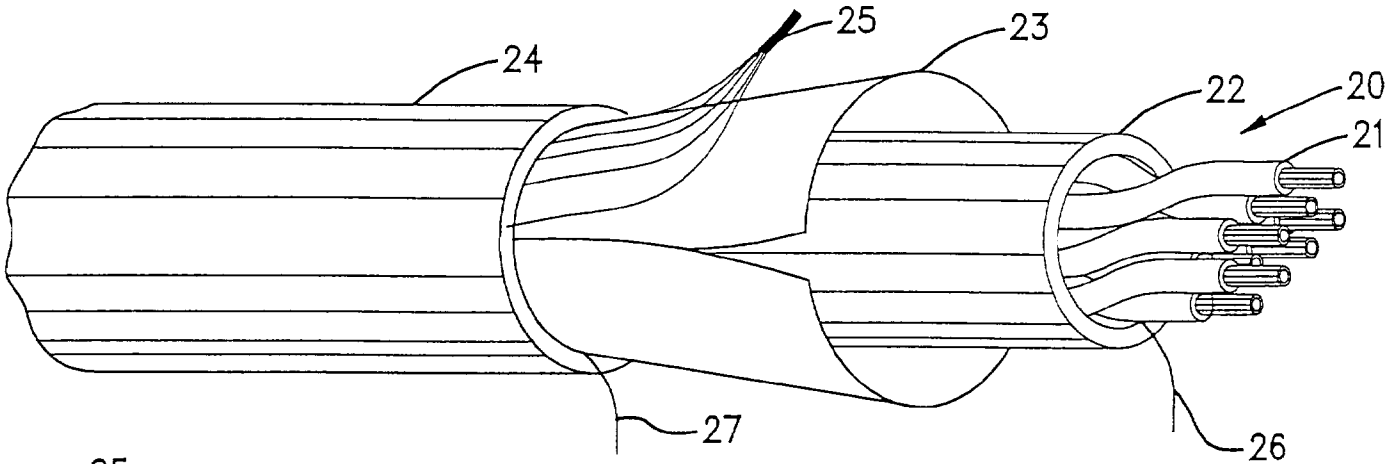
FIG. 2*a* is a perspective view of a shielded electrical cable according to one embodiment of the present invention.
Figure 2B:
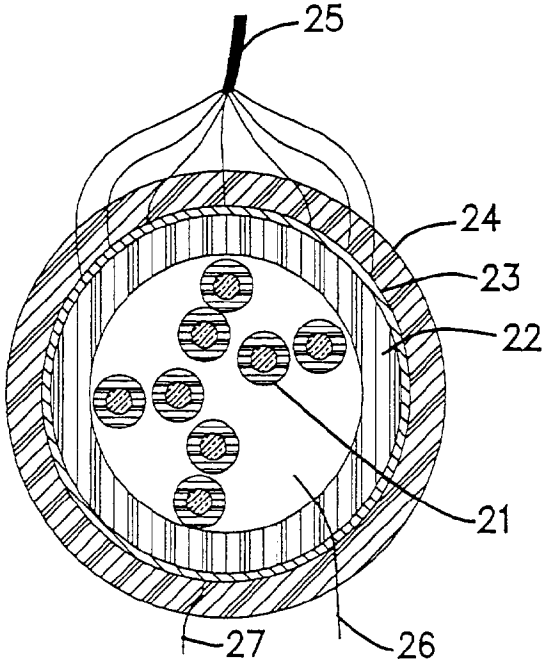
FIG. 2*b* is an end view of the cable of FIG. 2*a;*

Referring now to FIGS. 2*a* and 2*b*, we have shown a shielded dual jacket cable design according to a first embodiment of the present invention.

This cable design applies to non-plenum communication cables as well as to plenum communication cables, and is not limited to data grade cables according to the TIA/EIA specifications as mentioned earlier. This design applies for all types of communication cables and electronic cables where an overall shield or screen against electromagnetic energy is required under the cable jacket.

As shown in FIGS. 2*a* and 2*b*, the cable is comprised of a core 20 having two or more insulated conductors 21. A first or inner layer jacket 22 is applied over the core 20. A metallic shield 23 is then formed over the first layer jacket 22. A second or outer layer jacket 24 is then formed around the shield 23. Grounding or drain wires 25 are used as well, in this embodiment. A first and second rip cord 26 and 27 are disposed below the first and second jacket layers 22 and 24, respectively. The first layer jacket 22 may be made of a solid material or of a cellular (foamed) material.

Figure 3A:
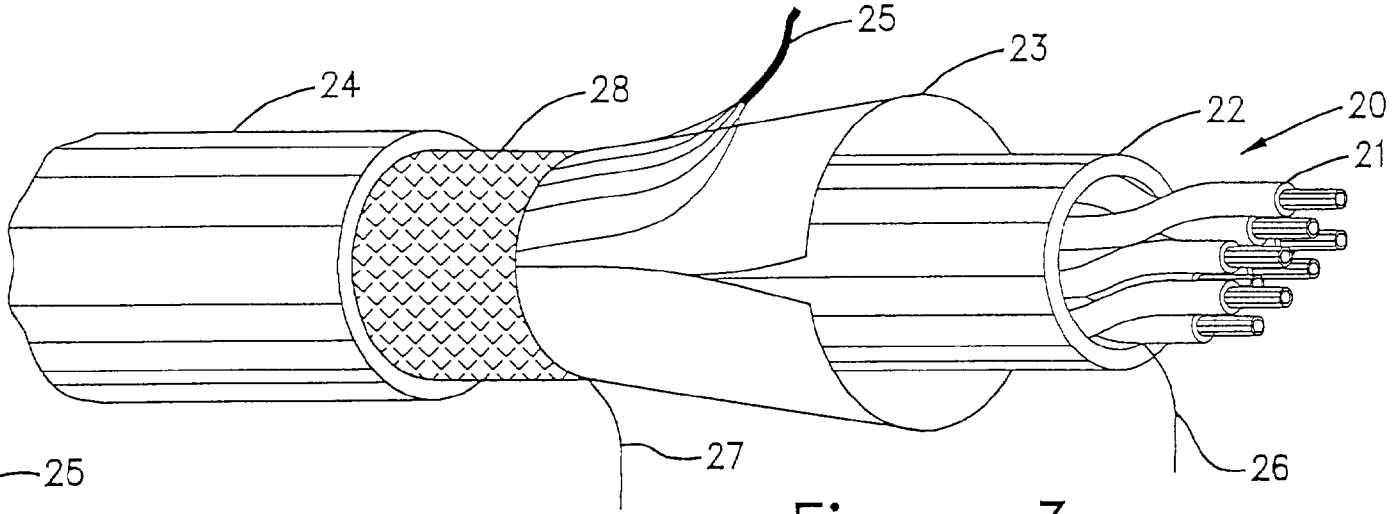
FIG. 3*a* is a perspective view of a shielded electrical cable according to another embodiment of the present invention.
Figure 3B:
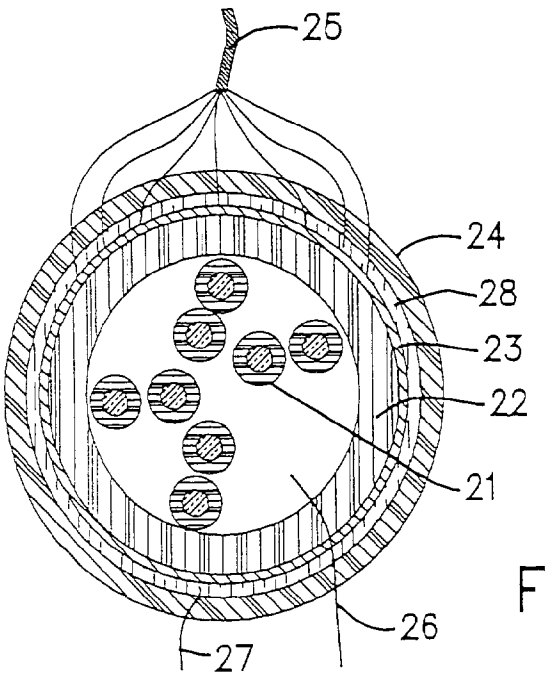
FIG. 3*b* is an end view of the cable of FIG. 3*a;*

In the embodiment shown in FIGS. 3*a* and 3*b*, a wire braided shield 28 is placed over the shielding tape 23.

The cable construction of FIGS. 2*a*, 2*b*, 3*a* and 3*b* incorporating a dual jacket facilitates the application of a screening shield (or foil shield) to ScTP and STP cables, and helps termination to ground of such cables.

In particular, the metallic tape or a metallic coated polymer tape (shielding tape or metallic foil tape) 23 can easily be formed around the first layer 22 of the dual layer construction, due to the uniformity and roundness of the layer. Subsequently, the second layer 24 and/or the wire braid shield 28 seal the tape on itself at the overlapping edges against the first jacket layer 22, creating a tight overlap and thereby improving the screening capabilities of the shield 23. Further improvement in the screening capabilities of the shield is obtained when one or both sides of the shielding tape contains an adhesive. The adhesive can be activated during the application of the second jacket layer, thereby causing a bond between the said shield and the first jacket layer and/or the second jacket layer. This bond improves the integrity of the shield and maintains its capabilities during manipulations. In addition, an improvement in the dielectric strength between the conductors 21 and the shield 23 is obtained, by having the first layer jacket 22 between them.

With the present cable design, quick locking grounding termination devices, or connectors, can be easily installed directly on the metallic foil 23 and/or wire braid 28, given the relative roundness and stability of the cable with the first jacket layer 22. The first jacket 22 also protects the underlaying insulated conductors 21 during the installation of such connecting devices. At the same time, the grounding conductor 25 can be eliminated and the duration of the installation considerably shortened. An example of quick locking mechanism used for shielded cable connectors is given by the AMP Co. in its EMC™ data connector. Such mechanisms can be envisaged for other termination devices.

The cable design of the present invention also provides potential savings in insulation materials achieved through the implementation of the dual jacket screened cable design. In the screened cable design of the prior art, a much better dielectric (i.e. insulation) for the conductors is required in order to compensate for the loss of signal that is caused by the proximity of a metallic substrate to the insulated conductors. The insulation of the conductors needs to be much thicker or needs to be foamed (cellular form) to a high percentage to meet the electrical specifications.

With this invention it was found that, by applying the shielding tape 23 on the first layer 22 of a dual jacket screened cable construction, the attenuation due to the shield is reduced considerably. In particular, by applying the shield 23 between a first layer 22 having a minimum thickness of 0.015 inch, but ideally within the range of 0.020 inch and 0.032 inch, and a second layer jacket 24, the resulting cable had an attenuation and a characteristic impedance equivalent to the unshielded cable with conductors having similar insulation types and thicknesses.

This improvement over the traditional design enables the designer to reduce considerably the thickness of the insulation of screened cables and still meet the EIA/TIA requirements. In one case, the solid insulation thickness of 24 AWG conductors for a non-plenum data cable was reduced from 0.013 inch to 0.0083 inch without any deterioration in the performance of the resulting cable. The same behaviour can be expected for cellular insulations. In fact, expanding the insulation to a cellular type, to increase the insulation thickness without using additional material, is not necessary with this new design.

For example, a four pair non-plenum cable made from 24 AWG copper and 0.0083 inch thick of high density polyethylene solid insulation with, in order, a 0.024 inch PVC circular first jacket, a 0.002 inch aluminum-polyester foil shield, and a 0.015 inch PVC second layer jacket ending with a cable overall diameter of approximately 0.255 inch will pass the TIA/EIA 568-A standard for Category 5 type cables. By contrast, the equivalent cables currently available in the marketplace have an overall diameter of approximately 0.265 inch. The construction proposed uses about 45% less insulation materials and approximately 33% more jacketing material by volume. The same reduction in insulation material usage is applicable for plenum cables. With such a design, it is advantageous to have a cellular inner jacket layer.

The required thickness of the first layer may differ, depending on the insulation material(s) and insulation thickness(es) used, and also whether the first layer jacket is tight on the conductors and not circular. The greater the insulation thickness is, the lower the thickness of the first layer jacket can be. The reverse of the latter statement is also true, but the limit is the minimum thickness of insulation required to pass the electrical transmissions requirements without the overall shield. Depending upon the materials used and the type of cable, somewhere within the range of thicknesses of both the insulation and the first layer jacket lies the most economical cable construction.

The utilization of the dual jacket design in screen cables achieves a significant reduction in material costs and it also reduces the installation costs when compared with existing designs. The reduction in material costs is particularly significant for plenum data grade constructions which use very expensive insulation and jacketing materials. A screen cable with smaller insulated conductors allows the termination hardware designers to reduce the dimensions of their own connection devices, thereby effecting a cost and space reduction of the entire network connectivity.

It was also found, that in similar fashion to the improvements achieved with the screened cable design, the utilization of a dual layer design enables the designer to use a second layer with a very high dielectric and loss factor such as PVDF for plenum cables, without an increase in insulation thickness as mentioned above, as illustrated below with another embodiment of this invention.

Examples of dual layer jacket designs, in comparison with prior art designs for screened cables can be made as follows:

| | | Jacketing Material | | |
|---|---|---|---|---|
| | | | Dual Layer | |
| Types of Cables | Insulation Material | Single | First | Second |
| Non-plenum high speed data grades | PO | PVC, or PO | PVC, or PO | PVC, or TPE, or TPR, or PO |
| Non-plenum electronic and low speed communication grades | PVC, or PO | PVC, or PO | PVC, or PO | PVC, or TPE, or TPR, or PO |
| Plenum high speed data grades | FEP, or FEP and PO; or PO | lsPVCba, or ECTFE | lsPVCba, or PO | lsPVCba, or PVDF, or ECTFE |
| Plenum electronic and low speed communication grades | lsPVC, or ECTFE | lsPVCba, or ECTFE, or PVDF | lsPVCba, or PO | IsPVCba, or PVDF, or ECTFE |

When using a fluoropolymer as insulation material, such a fluoropolymer has a signal dissipation factor of less than about $3\times10^{-4}$ and a dielectric constant of less than about 2.1 at high frequencies.

This invention is valuable to other types of communication and electronic cables, such as audio cables, computer cables, control and instrumentation cables, multiconductor cables with respect to the screening and shielding of the cables whether it be for plenum or non-plenum rated cables.

Figure 4A:
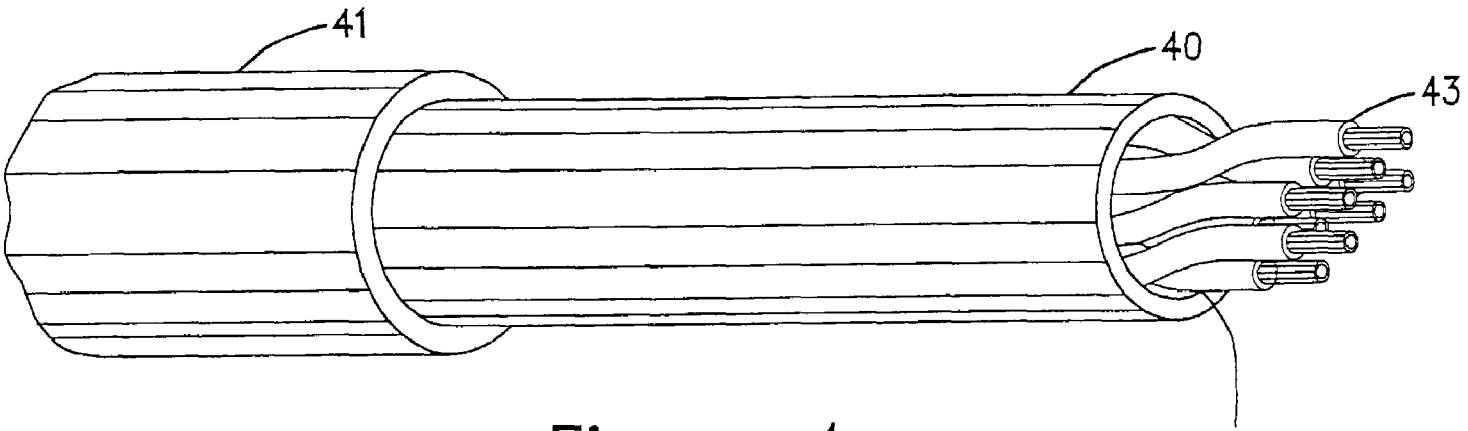
FIG. 4*a* is a perspective view of a plenum rated electrical cable according to another embodiment of the present invention.
Figure 4B:
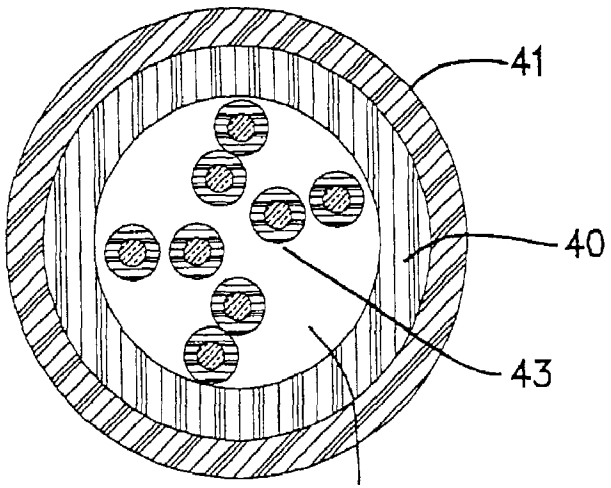
FIG. 4*b* is an end view of the cable of FIG. 4*a.*

Referring now to FIG. 4*a* and 4*b*, we have shown a cable design according to another embodiment of the present invention.

The present embodiment seeks to provide a cable design capable of qualifying for approved use in plenum spaces with the use of polyolefin insulation materials, with or without flame retardants and/or smoke suppressants. At the same time, the cable designs meet and even exceed the present ANSI/EIA-TIA specifications for transmission frequencies of at least 100 MHz.

The cable design of the present invention limits the smoke emission and the flame spread generated by cable constructions using polyolefin insulation substitutes by employing a dual layer jacket in which the first layer 40 consists of either a flame retardant and low smoke polyvinyl chloride based polymer or a low smoke and flame retardant polyolefin containing non-halogenated additives. The first layer 40 could be expanded or foamed during the jacketing process and must display a sufficiently low dielectric and dissipation factors if the resulting cable should meet the present ANSI/EIA-TIA specifications. The second layer 41, which may be the layer that provides mechanical protection to the cable as per the NEC requirements, is a fluoropolymer material which has very high flame retardancy and low smoke emission properties. Two fluoropolymer materials having these properties were used in cable constructions reported herewith, namely EthyleneChloroTriFluoroEthylene (ECTFE) and Polyvinylidene Fluoride (PVDF) polymers and copolymers. The latter material does display very high dielectric constant and dissipation factor, especially at high signal transmission frequencies. When such materials are in close contact with the insulated conductors 43 of a high performance data grade cable, an increase of the signal attenuation at high frequencies is observed in a similar fashion as the effect of a metallic shield mentioned above in the first embodiment of the present invention. For that reason, polyvinylidene fluoride (PVDF) polymers, and the like, are not presently used for high performance data grade cables.

It was found that, using insulated conductors 43 similar to the prior art, polyvinylidene fluoride (PVDF) can be used as the second jacket layer 41 without relatively affecting the signal attenuation, when the first layer material 40 has a thickness of at least 0.015 inch, but most ideally in the range 0.017 inch to 0.030 inch, with the shape of the first layer 40 being relatively circular. The required thickness of the first layer 40 may differ, if the first layer jacket is tight on the conductors 43 and not circular. The exact thickness required for the first jacket 40 will depend upon the insulation material(s) and thickness(es) used. These design parameters are identical to the ones observed above during the development of the ScTP cable with the dual jacket construction.

For example, a four pair cable made from 24 AWG copper and 0.008 inch thick of a flame retardant and smoke suppressant polyolefin solid insulation with a 0.020 inch thick low smoke PVC based alloy compound circular first jacket followed by a 0.010 inch thick PVDF second layer jacket exceeds the TIA/EIA 568-A standard for Category 5 type cables.

It was also found that for an equivalent overall thickness, a dual jacket consisting of a low smoke polyvinyl chloride and a top layer consisting of a fluoropolymer material (PVDF or ECTFE) will perform better than a single layer of a similar low smoke polyvinyl chloride. For example, when tested in accordance with UL 910, a dual layer cable construction having a construction as above in the ratio of thicknesses of 3 to 1, respectively, had equivalent smoke emission but had better flame spread results by about 50% when compared to an equivalent (in thickness) single layer construction having a nominal thickness of 0.030 inch. Both cable constructions had the same core of 8 conductors that were insulated with polyolefins.

With respect to the effect of PVDF as the second layer jacket, the greater the insulation thickness is, the lower the thickness of the first layer jacket can be. The reverse of the latter statement is also true. The ratios between the amounts of fluoropolymers used for jacketing and insulation, and the amount of low smoke PVC used for jacketing, and the amount of polyolefin materials used for insulation are dictated by the requirements to meet UL-910/NFPA 262 flame spread and smoke test as well as the TIA/EIA specifications. The appropriate ratios are described in applicant's copending U.S. patent application Ser. No. 08/527,531 and the Canadian patent application Serial No. 2,157,322.

It is widely known from the literature that the low smoke PVC based alloys are susceptible to accelerated degradation when exposed to high humidity and high temperatures for relatively short periods of time. This environmental degradation results in a marked deterioration of the cable transmission parameters. In particular, the signal loss—attenuation—measurements as a function of frequency could show an increase by up to 20%. The use of a top fluoropolymer jacket layer in the proposed dual layer design for plenum rated cables has an additional unsuspected benefit. It was found that by applying a fluoropolymer second layer as in the proposed dual layer design for plenum rated cables, the observed deterioration is reduced to less than 5%.

An added benefit of the fluoropolymer layer is the inherent low dynamic and static friction of the material that improves the effort required during the installation of cables.

The materials covered for use as the second jacket layer include polymers, copolymers, alloys, blends and compounds of PVDF or of ECTFE.

This invention reduces the cost of plenum data grade cables by incorporating a higher ratio of polyolefin substitutes to fluoropolymer for the insulation material for a given overall jacket thickness. It also provides a thinner overall jacket thickness for a given polyolefin to fluoropolymer ratio for the conductor insulation, or a combination of the two alternatives. Material combinations such as described herein also provide cables that are easier to install and that display improved resistance to combined high temperature humidity.

Variations of the particular embodiment herewith described will be obvious to one skilled in the art, and accordingly the embodiment is to be taken as illustrative rather than limitive, the true scope of the invention being set out in the appended claims.

The invention claimed is:

1. A data communication cable comprising:

at least one twisted pair of insulated conductors;

an insulation layer comprising a polymer surrounding each conductor of the at least one twisted pair of insulated conductors, the insulation layer having a first thickness;

a first jacket layer surrounding the insulation layer, the first jacket comprising a material having flame-resistant and smoke-suppressive properties;

a second jacket layer surrounding the first jacket layer, the second jacket layer comprising a polyvinyl chloride material containing flame-resistant and smoke-suppressive additives; and a metallic shield disposed underneath the second jacket layer and surrounding the first jacket layer;

wherein the first jacket layer has a substantially uniformly smooth outer circumference along substantially a whole length of the cable;

wherein a thickness of the first jacket layer is selected so as to provide the data communication cable with electrical signal attenuation and impedance characteristics substantially equivalent to those of an unshielded cable including a twisted pair of insulated conductors with insulation thicknesses similar to the first insulation thickness;

wherein the first jacket layer is circular in cross-section with a thickness of between 0.015 inch and 0.032 inch; and wherein the first jacket layer comprises a polyolefin containing non-halogenated flame-resistant and smoke suppressive additives.

2. The data communication cable as claimed in claim 1, wherein the first jacket layer is circular in cross-section with a thickness of approximately 0.015 inch.

3. The data communication cable as claimed in claim 1, wherein the metallic shield comprises a wire braided shield.

4. The data communication cable as claimed in claim 1, wherein the metallic shield comprises a metallic foil tape.

5. The data communication cable as claimed in claim 4, wherein the metallic foil tape further comprises a metallic coated polymer tape and wire braided shield overlaid over the metallic foil tape.

6. The data communication cable as claimed in claim 5, wherein a grounding conductor is disposed between the metallic foil tape and the wire braided shield.

7. The data communication cable as claimed in claim 4, wherein the metallic foil tape comprises an adhesive coating on at least one side thereof, the adhesive coating being activated during application of the second jacket layer.

8. The data communication cable as claimed in claim 4, wherein a grounding conductor is disposed between the metallic foil tape and the second jacket layer.

9. The data communication cable as claimed in claim 4, wherein a grounding conductor is disposed between the metallic foil tape and the first jacket layer.

10. The data communication cable as claimed in claim 1, further comprising a first jacket rip cord disposed with the conductors under the first jacket layer and a second jacket rip cord disposed between the metallic shield and the second jacket layer.

11. The data communication cable as claimed in claim 1, wherein the first jacket layer comprises an expanded polyolefin foam containing non-halogenated flame-resistant and smoke-suppressive additives.

12. The data communication cable as claimed in claim 1, wherein the insulation layer is a fluoropolymer selected from a group of polymers comprising fluorinated ethylene propylene polymers, perfluoroalkoxy fluorinated ethylene polymers and methylfluoroalkoxy fluorinated ethylene polymers.

13. The data communication cable as claimed in claim 1, wherein the insulation layer comprises a polyolefin.

14. The data communication cable as claimed in claim 1, wherein the insulation layer comprises a fluoropolymer.

15. The data communication cable as claimed in claim 1, wherein the at least one twisted pair of insulated conductors includes 24 AWG conductors, and wherein the first insulation thickness is approximately 0.008 inch.

16. The screened twisted pair cable as claimed in claim 1, wherein the insulation material includes high density polyethylene.

* * * * *

UNITED STATES PATENT AND TRADEMARK OFFICE

CERTIFICATE OF CORRECTION

PATENT NO. : 7,276,664 B2
APPLICATION NO. : 10/187476
DATED : October 2, 2007
INVENTOR(S) : Gilles Gagnon It is certified that error appears in the above-identified patent and that said Letters Patent is hereby corrected as shown below:

In column 1, line 44, "ANSI/EA/TIA" should read --ANSI/EIA/TIA--

Signed and Sealed this

Eighteenth Day of December, 2007

JON W. DUDAS
*Director of the United States Patent and Trademark Office*